US007761955B1

(12) United States Patent
Hiltz

(10) Patent No.: US 7,761,955 B1
(45) Date of Patent: Jul. 27, 2010

(54) DUAL PORT CLEANING AND EXTRACTION APPARATUS

(76) Inventor: Erik D. Hiltz, 27564 Weddel Ave., Brownstown Twp., MI (US) 48183

( * ) Notice: Subject to any disclaimer, the term of this patent is extended or adjusted under 35 U.S.C. 154(b) by 6 days.

(21) Appl. No.: 12/231,408

(22) Filed: Sep. 2, 2008

Related U.S. Application Data

(60) Provisional application No. 60/966,913, filed on Aug. 30, 2007.

(51) Int. Cl.
*A47L 7/00* (2006.01)

(52) U.S. Cl. ..... 15/322; 15/362; 15/401; 15/416

(58) Field of Classification Search ..... 15/320, 15/321, 322, 362, 416, 401; *A47L 7/00*
See application file for complete search history.

(56) References Cited

U.S. PATENT DOCUMENTS

| | | | | |
|---|---|---|---|---|
| 4,069,541 | A | 1/1978 | Williams | |
| 4,137,600 | A | 2/1979 | Albishausen | |
| 4,164,055 | A * | 8/1979 | Townsend | 15/321 |
| 4,333,203 | A | 6/1982 | Yonkers | |
| 4,485,518 | A | 12/1984 | Kasper | |
| 5,075,921 | A | 12/1991 | Gleadall | |
| 5,113,547 | A | 5/1992 | Mayhew | |
| 5,157,805 | A | 10/1992 | Pinter | |
| 5,180,439 | A | 1/1993 | Allison | |
| 5,485,652 | A | 1/1996 | Holland | |
| 5,555,598 | A | 9/1996 | Grave | |
| 5,752,289 | A | 5/1998 | Collins | |
| 5,891,198 | A | 4/1999 | Pearlstein | |
| 6,055,699 | A | 5/2000 | Cho | |
| 6,152,151 | A | 11/2000 | Bolden | |
| 6,263,539 | B1 | 7/2001 | Baig | |
| 6,449,799 | B1 * | 9/2002 | Keller | 15/322 |
| 6,453,506 | B1 | 9/2002 | Sumner | |
| 6,598,262 | B2 * | 7/2003 | Farina | 15/321 |
| 6,852,858 | B2 * | 2/2005 | Feher et al. | 544/281 |

* cited by examiner

*Primary Examiner*—David A Redding
(74) *Attorney, Agent, or Firm*—Carrier, Blackman & Associates P.C.; Joseph P. Carrier; William D. Blackman

(57) ABSTRACT

Apparatus for and method of cleaning or extracting liquid from carpet coupled to a truck mounted or portable carpet cleaning machine. The apparatus includes an elongated non-fixed handle that is attached to a vacuum head with two inlet ports parallel to one another. A solution manifold is attached parallel between the two ports. A plurality of spray jets derive from the spray manifold. A wheel assembly is mounted for stability of the vacuum head and are adjustable.

20 Claims, 5 Drawing Sheets

DUAL PORT CLEANING AND EXTRACTION APPARATUS

CROSS-REFERENCE TO RELATED APPLICATIONS

This application claims the benefit of provisional patent application Ser. No. 60/966,913, filed 2007 Aug. 30 by the present inventor.

FEDERALLY SPONSORED RESEARCH

Not Applicable

SEQUENCE LISTING OR PROGRAM

Not Applicable

BACKGROUND

1. Field

This application relates to an apparatus and method for cleaning and removing liquids from carpets or similar fabrics.

2. Prior Art

Typically, professional carpet cleaners utilize truck mounted commercial carpet cleaning machines or portable carpet cleaning machines. These machines use long hoses and fluid lines to provide vacuum and water or a cleaning solution to a wand.

Wands typically consist of a long tubular pipe with one vacuum head having a vacuum port and a spray manifold or nozzle attached thereto.

The problem with a traditional wand lies in the design. Wands generally consist of one vacuum port which can only clean on a backwards motion. Consequently, the wand is moving in both directions, but only cleaning on the backwards movement. This causes a lot of wasted energy and fatigue.

The cleaning of large areas of carpeting is a time consuming and strenuous task. The extensive effort which is needed in order to push and pull the wand across the carpet can quickly fatigue a person using a traditional wand. In a commercial carpet cleaning operation, where large areas of carpeting are cleaned daily, fatigue will significantly place a limit on production rate.

Commercial carpet cleaning machines typically generate tremendous vacuum pressure which is then applied to the carpet through the wand. The vacuum pressure often causes the traditional wand to dig into the carpet, raising the inches of lift. Therefore, deadening the air-flow causing static lift. This causes the forward movement of the wand to be very strenuous.

Typically, a wand is constructed of a solid pipe with a fixed handle during operation. This causes the operator to tilt his or her body to one side, while slightly lifting the wand with their lead hand. All of the force and weight while moving the traditional wand vertically is applied to your shoulder and lower back. This causes unnatural twisting and turning of the human body, resulting in excessive strain on the lower back and shoulder.

Even with the problems associated with traditional cleaning wands, the truck mounted cleaning machines are still considered the most effective means for extracting water and cleaning carpet. Consequently, there is a need to improve the design and use of the traditional cleaning wand.

Several advantages of one or more aspects is to provide a cleaning apparatus with one vacuum head with two inlet ports that moves with ease and cleans and extracts both forward and backward. Another advantage of one or more aspects is to provide a cleaning apparatus which alleviates some of the strains and stress inflicted on the human body while cleaning carpet. Furthermore, other advantages of one or more aspects is to provide a head design which allows for increased airflow and improved drying time. These and other advantages will be described in greater detail hereinafter. One or more features solve the above-mentioned and utilizes a number of unique features that render it highly beneficial over prior art.

There are a number of patents disclosing various apparatuses which will accomplish, in general terms, some of the above-noted functions. The following patents are presented to aid in understanding and to some extent related to the current invention:

U.S. Pat. No. 4,069,541 to Williams, et al. (1978)

U.S. Pat. No. 4,137,600 to Albishausen (1979)

U.S. Pat. No. 4,333,203 to Yonkers (1982)

U.S. Pat. No. 4,485,518 to Kasper (1984)

U.S. Pat. No. 5,075,921 to Gleadall (1991)

U.S. Pat. No. 5,113,547 to Mayhew (1992)

U.S. Pat. No. 5,157,805 to Pinter (1992)

U.S. Pat. No. 5,180,439 to Allison (1993)

U.S. Pat. No. 5,485,652 to Holland (1996)

U.S. Pat. No. 5,555,598 to Grave, et al. (1996)

U.S. Pat. No. 5,752,289 to Collins (1998)

U.S. Pat. No. 5,891,198 to Pearlstein (1999)

U.S. Pat. No. 6,055,699 to Cho (2000)

U.S. Pat. No. 6,152,151 to Bolden, et al. (2000)

U.S. Pat. No. 6,263,539 to Baig (2001)

U.S. Pat. No. 6,453,506 to Sumner (2002)

SUMMARY

In accordance with one embodiment, the present invention addresses the limitations of the aforementioned prior art by providing a method for cleaning and/or extracting liquids from carpets or like fabrics.

This cleaning apparatus, unlike prior art, has one vacuum head with two inlet ports parallel to one another. As will be described in further detail, these inlet ports are positioned so that both ports penetrate the carpet fibers at an even depth at all times during operation. This unique feature allows for balanced airflow in the vacuum head due to the operator having no control of lifting the front or back ports off the ground due to the handle having a non-fixed position during operation.

The open air space in the top portion of the vacuum head creates a dynamic lift and an inverse relationship between lift and airflow. This coupled with the glides greatly increases airflow for smoother operation and faster dry times.

BRIEF DESCRIPTION OF DRAWINGS

Figures

DETAILED DESCRIPTION

Figure 1:
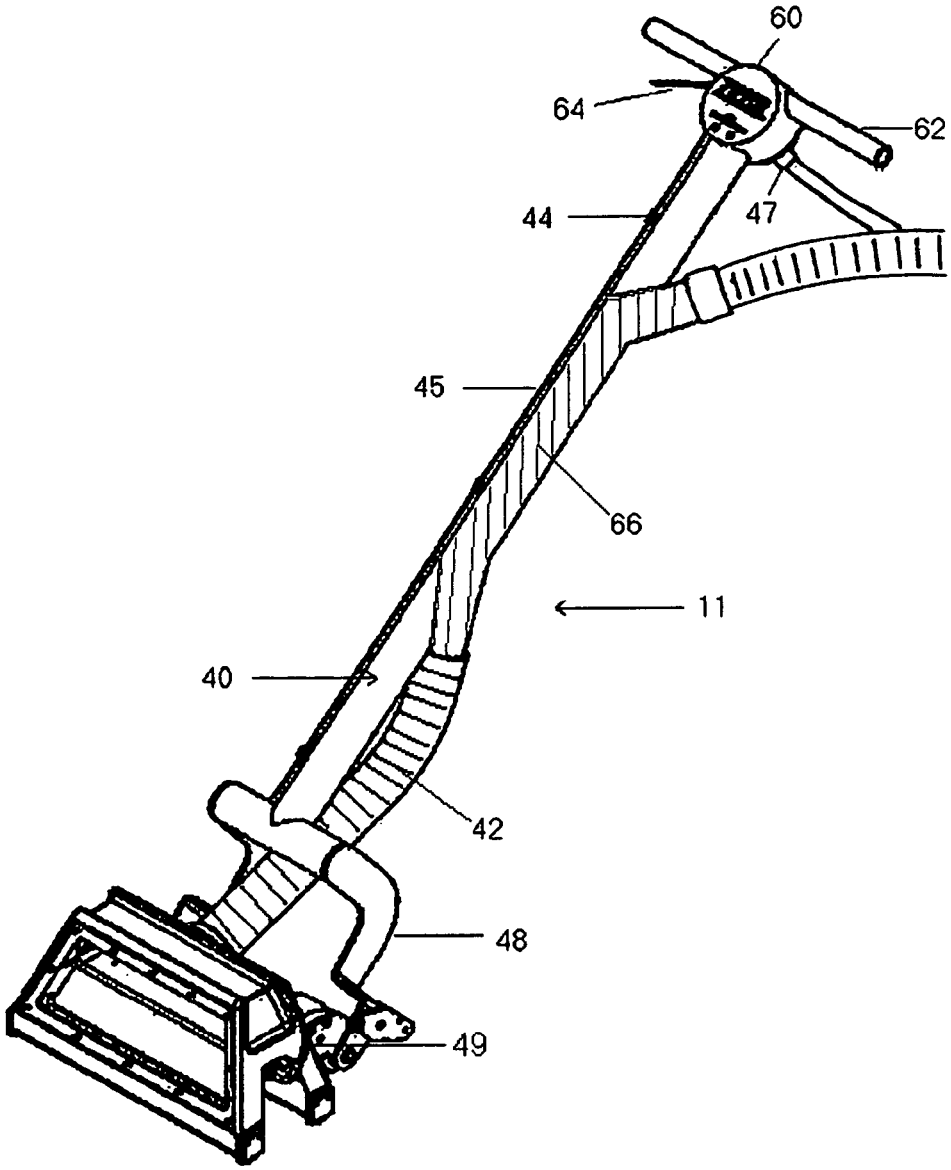
FIG. 1 is a perspective view of one embodiment of the present invention.

Referring to FIGS. 1, 2, 4, and 6. One embodiment of the apparatus 11 is preferably coupled to a truck mounted cleaning machine with 2 inch vacuum hose or a similar flexible conduit and ¼ inch or similar high pressure/high temperature solution line. The vacuum hose is coupled to a vacuum passageway 66 closest to valve 60. The high pressure/high temperature solution line is coupled to valve 60 using ¼ inch male and female quick connect couplers or similar hardware.

Valve 60 is designed to allow the cleaning solution to flow from solution inlet 47 to solution line 45 when solution lever 64 is depressed pulled toward handle bar 62. Solution lever 64 is coupled to valve 60 with a shoulder bolt and a roll pin to keep the lever in the correct position for operation.

Valve 60, unlike prior art, is formed from four inch bar stock using a machining process known as billet. Valve 60 is machined from a single piece of aluminum, but may also be fabricated by welding or otherwise securing just described components together.

When solution lever 64 is depressed, cleaning solution passes from solution inlet 47 through valve 60 out to solution line 45. Solution line 45 is coupled to solution tee 37 and solution line 45 is attached to handle arm 40 using solution line clip 44. Cleaning solution is then directed from solution tee 37, bi-directionally, to stainless steel, or like material, solution line 49. Solution line 49 is coupled to a ninety degree line fitting 36. Ninety degree line fitting 36 is coupled to solution manifold 32. Solution jets 69 are attached to solution manifold 32.

Solution manifold 32 is designed to allow for adjustment. In initial configuration, solution manifold 32 should be set so that solution jets 69 are directing cleaning solution spray about ¼ inch behind front vacuum port 13. Attached to solution manifold 32 are six check valves 68. Each check valve is terminated by a solution jet 69. Solution manifold 32 is attached to vacuum head 12 with 2 manifold brackets 34.

Figure 3:
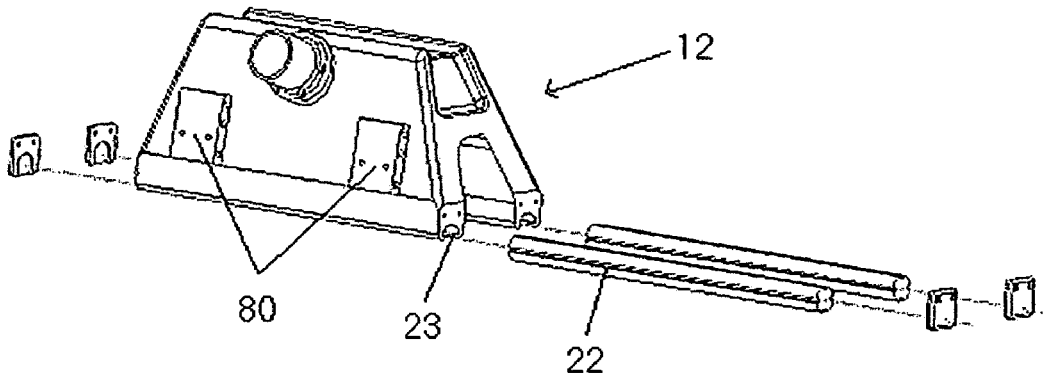
FIG. 3 is a back view of the vacuum head embodiment with the glides and glide retainers removed.
Figure 4:
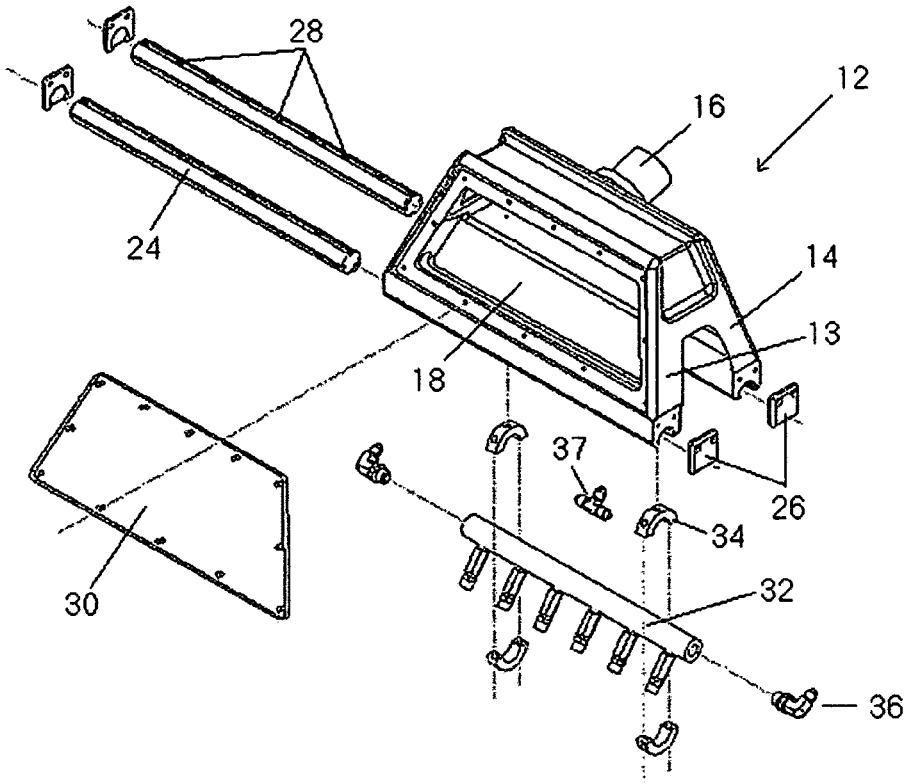
FIG. 4 is an exploded view of the vacuum head embodiment and assemblies.
Figure 6:
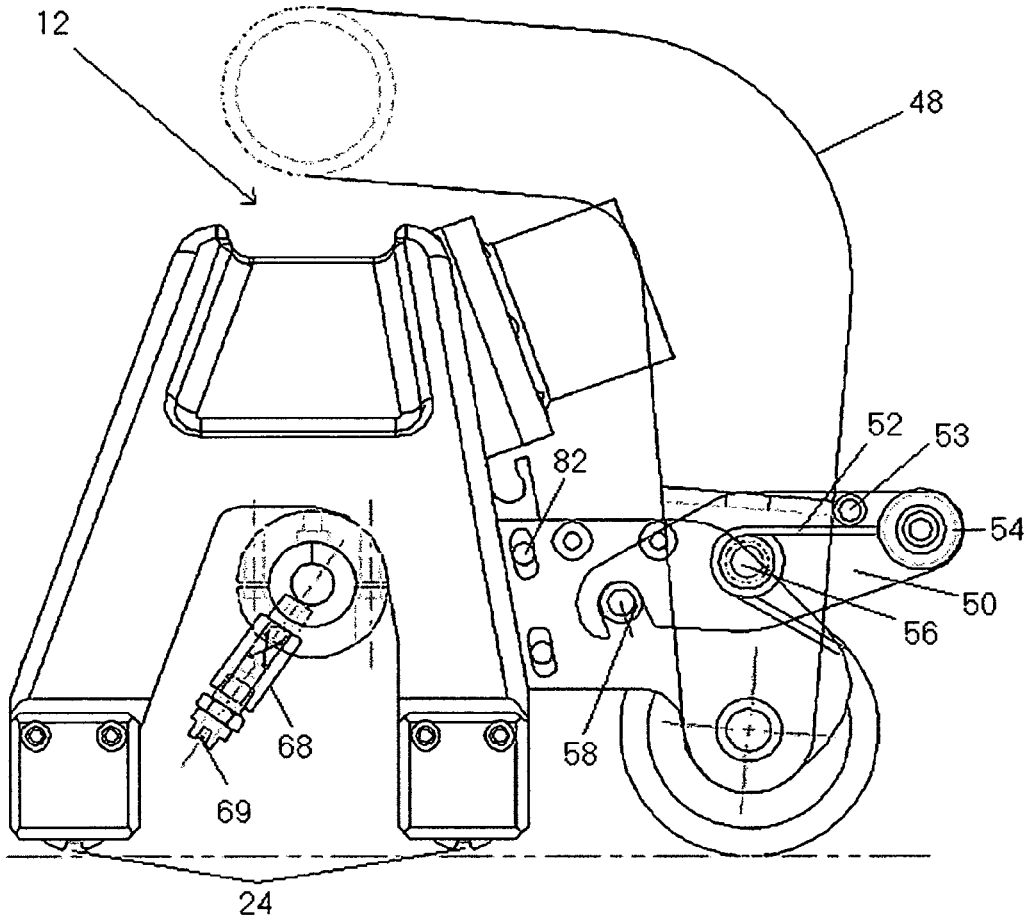
FIG. 6 is a side view of the complete vacuum head embodiment.

Referring to FIGS. 3 and 6. Vacuum head 12 is formed from a single block of aluminum using a machining process known as billet. Unlike prior art, vacuum head 12 is designed this way to accommodate the rounded design of our glides 24. Glides 24 are inserted into vacuum ports 13 and 14 along male glide channels 23 formed to project into opposite sides of each of the ports 13, 14 and female glide channels 22 formed into each glide on opposite sides thereof so as to slidingly receive the male glide channels 23. Using this method allows us to have a reversible glide that is round in design, such that opposite (upper or lower) sides of the glides may be selectively positioned to project from the lower face of the vacuum head, without having void areas in the chambers above glide channels 22 and 23. This feature doubles the life of the glides 24. The support bridges 28 are recessed far enough into glides 24 to allow for glides to wear down/out and not reach bridges 28 to break up the vacuum into separate chambers. This feature eliminates bridge lines in the carpet being cleaned. These glides are held in place, preventing lateral movement, using four glide retainers 26, which also serve as a bumper to prevent scratching of walls, baseboards, and other objects. Glides 24 are designed to allow for maximum air flow, stability of vacuum head 12, and to reduce friction on the cleaning surface.

Referring to FIGS. 1, 3, 5, and 6. To maintain the stability of vacuum head 12, convex wheels 38 can be adjusted. Unlike prior art, wheels 38 are designed such that the entire apparatus can be moved laterally across the cleaning surface. Wheels 38 are connected to inside/outside brackets 70 and 72 using an axle bolt 74 inserted through bushing 76 which is inserted through wheel 38. Brackets 70 and 72 are connected to wheel bracket mounts 80 using retainers such as screws, bolts, or other such hardware.

To achieve the adjustment that is necessary for vacuum head stability, brackets 70 and 72 are designed in such a way that they can be adjusted using wheel bracket adjustment slots 82. These are oblong slots cut into brackets 70 and 72. The purpose of this adjustment is to ensure that the glides and wheels remain level at all times during operation.

Figure 5:
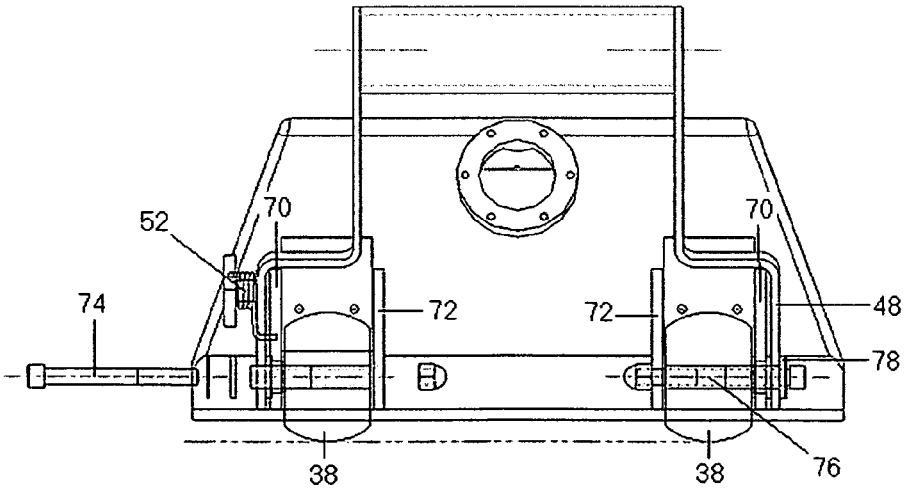
FIG. 5 is a back view of handle brackets and wheel assembly.

Referring to FIGS. 1 and 5. Handle arm bracket 48 is connected to axles 74 through oil lite bushings 78. Unlike prior art, combined with a stable (dual port) vacuum head with adjustable wheels, this allows handle arm 40 to pivot in a non-fixed position during operation. The non-fixed handle arm allows the operator to maintain an erect posture during operation.

Referring to FIGS. 1 and 6. When handle arm 40 is fully upright, it is locked into position. This is achieved when handle latch 50 is resting on latch pin 58. To release handle arm 40 for operation, pressure is applied downward on foot peg 54. This compresses torsion spring 52 which is attached to shoulder bolt 56. Shoulder bolt 56 is connected to handle bracket 48. Handle bracket 48 is welded to handle arm 40. This process lifts handle latch 50 off of latch pin 58, releasing the handle arm. To keep torsion spring 52 from depressing and to keep handle latch 50 in proper position, latch stopper 53 is used to keep tension on torsion spring 52.

Referring to FIG. 6. When in operation, on a forward movement, waste water is extracted from carpet through glide 24 channeled through back vacuum port 14 and into inside vacuum chamber 18. On a backward movement, waste water is extracted from carpet through glide 24 channeled through front vacuum port 13 and into inside vacuum chamber 18. Vacuum chamber cover 30 is attached to vacuum head 12. In this use, chamber cover 30 is made from lexan but can be made from any material which would seal the vacuum chamber. Vacuum chamber 18 is an open area of attic space milled above the vacuum ports in vacuum head 12 where the airflow is maintained. As shown, the vacuum chamber extends substantially the full length and width of the vacuum head 12 at the upper portion of the head, and has a volume greater than either of front and rear vacuum ports.

Unlike prior art, vacuum chamber 18 allows for constant airflow distributed evenly through the front and rear vacuum ports. This creates a dynamic lift and an inverse relationship between lift and airflow. This coupled with the glides helps to increase the airflow for smoother operation and faster dry times.

Figure 2:
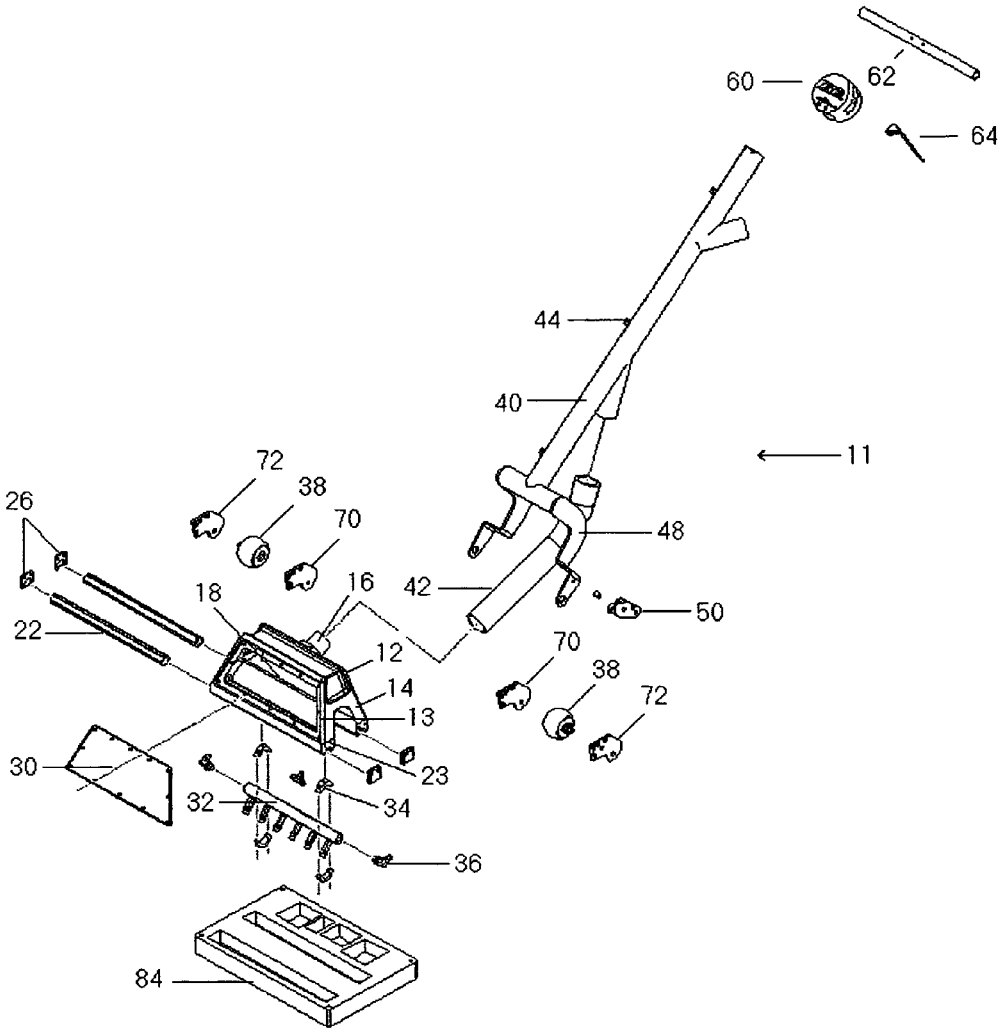
FIG. 2 is an exploded view of the device of FIG. 1.

Referring to FIGS. 1 and 2. Waste water moves through vacuum chamber 18 into outlet vacuum flange 16. Outlet vacuum flange 16 is coupled to liquid passageway 66 utilizing a two inch flexible vacuum hose 42. Liquid passageway 66 is connected to a flexible vacuum hose where waste water is extracted into the cleaning system.

Referring to FIG. 2. Setup tray 84 houses sections for replacement parts, tools, and is used to adjust the wheels and as a storage and shipping mount for the apparatus.

I claim:

1. An apparatus for cleaning and extracting water from carpet, comprising:

a vacuum head including a vacuum chamber configured to be connected to a vacuum source and two downward facing elongate vacuum ports extending downwardly from the vacuum chamber; and an elongate solution manifold mounted between said vacuum ports and configured to discharge cleaning liquid in a space between the vacuum ports, wherein said vacuum ports are configured to extract waste liquid from carpet when said vacuum head is moved in both a forward motion and a backward motion of the vacuum head, wherein said vacuum head further includes elongate glides sealingly fitted in lower openings of said vacuum ports, said glides having suction openings formed therein through which fluids may be drawing into said vacuum ports, and said glides project below the bottom face of said vacuum head.

2. The apparatus of claim 1 wherein said vacuum chamber includes a single open space above the said vacuum ports and which opens into said vacuum ports, the vacuum chamber extends substantially the full length and width of the vacuum head 12 at the upper portion of the head and has a volume greater than either of front and rear vacuum ports to thereby create a dynamic lift when connected to the vacuum source.

3. The apparatus of claim 1 wherein said vacuum head body is formed from a single block of aluminum.

4. The apparatus of claim 1, further comprising a non-fixed handle having one end pivotally connected to said vacuum head and a gripping portion provided at an opposite end which is configured to be gripped and manipulated by an operator using the apparatus, and a securing mechanism for selectively securing the handle in a non-pivoting, non-use position thereof.

5. The apparatus of claim 4 wherein said vacuum head further includes a device for facilitating movement of said vacuum head over carpeting, said movement facilitating device is adjustable such that a vertical position thereof relative to the vacuum head is selectively adjustable by an operator to a position level with bottom surfaces of said glides.

6. The apparatus of claim 5 wherein said movement facilitating device is a wheel positioned at a rear portion of the vacuum and is adjustable such that a lower surface of the wheel is at substantially the same level as that of the bottom surfaces of said glides.

7. An apparatus for cleaning and extracting water from carpet, comprising:

a vacuum head including a vacuum chamber configured to be connected to a vacuum source and two downward facing elongate vacuum ports extending downwardly from the vacuum chamber; and an elongate solution manifold mounted in parallel between said vacuum ports and configured to discharge cleaning liquid in a space between the vacuum ports, wherein said vacuum ports are configured to extract waste liquid from carpet when said vacuum head is moved in both a forward motion and a backward motion of the vacuum head, wherein the vacuum head further includes glide channels formed in lower portions of said vacuum ports and glides connected in said glide channels such that the glides project from a lower face of the vacuum head and seal lower openings of said vacuum ports and vacuum chamber, said glides having openings formed therein through which waste liquid may be draw into the vacuum ports.

8. The apparatus of claim 7 wherein said glides are glides are reversible relative to the glide channels such that opposite sides of the glides may be selectively positioned to project from the lower face of the vacuum head, and said glides are formed of plastic.

9. The apparatus of claim 7 wherein said glides and glide openings are elongate, and at least one of said glides contains a bridge which is recessed into said glide.

10. The apparatus of claim 7 wherein said glide channels include glide retainers which lock said glides into the lower portions of said vacuum ports and also function as bumpers of the vacuum head.

11. A carpet cleaning apparatus comprising:

a movable vacuum head configured to engage carpeting and extract liquids from the carpeting, said vacuum head being operatively connectable to a vacuum source; and an elongate handle having one end connected to said vacuum head and an opposite end configured to be gripped by an operator for manually manipulating the apparatus;

wherein said vacuum head includes a vacuum chamber configured to be connected to the vacuum source and a pair of elongate vacuum ports extending downwardly from said vacuum chamber to a bottom face of the vacuum head and spaced from each other in a movement direction of the vacuum head;

wherein said vacuum head further includes elongate glides sealingly fitted in lower openings of said vacuum ports, said glides having suction openings formed therein through which fluids may be drawing into said vacuum ports, and said glides project below the bottom face of said vacuum head.

12. The apparatus of claim 11, further comprising an elongate solution manifold connected to said vacuum head intermediate said pair of vacuum ports and configured to discharge a cleaning solution in a space between the vacuum ports, and a solution discharge valve connected near the opposite end of said handle and configured to be manipulated by the operator for selectively discharging the cleaning solution from said solution manifold.

13. The apparatus of claim 12, wherein said elongate solution manifold is disposed substantially parallel to said pair of elongate vacuum ports and includes plural solution discharge nozzles spaced from each other in a longitudinal direction of the manifold.

14. The apparatus of claim 11, wherein said elongate vacuum ports extend substantially parallel to each other and substantially perpendicular to the movement direction of the vacuum head.

15. The apparatus of claim 11, wherein said glides are reversible relative to said vacuum ports and are configured such that the operator may selectively position opposite sides of the glides to project below the bottom face of the vacuum head.

16. The apparatus of claim 11, wherein said vacuum head further includes at least one wheel positioned at a rear portion of the vacuum head for facilitating movement of said vacuum head over carpeting, said at least one wheel is adjustable such that a vertical position thereof relative to the vacuum head is selectively adjustable by an operator.

17. The apparatus of claim 11 wherein at least one of said glides contains a bridge which is recessed said glide.

18. The apparatus of claim 11 wherein said one end of said handle is pivotally connected to said vacuum head such that that handle can pivotally move relative to the vacuum head during a cleaning operation, and said handle further includes a securing mechanism for selectively securing the handle in a non-pivoting, non-use position thereof.

19. The apparatus of claim 11, wherein said vacuum head further includes at least movement facilitating device positioned at a rear portion of the vacuum head for facilitating movement of said vacuum head over carpeting, and said movement facilitating device is adjustable relative to the vacuum head such that a position of the movement facilitating device corresponds to bottom surfaces of said glides.

20. The apparatus of claim 11, further comprising a plurality of jets connected to said vacuum head intermediate said pair of vacuum ports and configured to discharge a cleaning solution in a space between the vacuum ports, said jets being disposed in spaced relation to each other and adjustable relative to the vacuum head.

* * * * *